US012628929B2

(12) United States Patent
Peel et al.

(10) Patent No.: US 12,628,929 B2
(45) Date of Patent: May 19, 2026

(54) HAIRCARE APPLIANCE

(71) Applicant: Dyson Technology Limited, Wiltshire (GB)

(72) Inventors: Ayrton Lloyd Taylor Peel, Gloucester (GB); Robert Mark Brett Coulton, Bristol (GB)

(73) Assignee: Dyson Technology Limited, Malmesbury (GB)

( * ) Notice: Subject to any disclaimer, the term of this patent is extended or adjusted under 35 U.S.C. 154(b) by 330 days.

(21) Appl. No.: 18/268,337

(22) PCT Filed: Dec. 3, 2021

(86) PCT No.: PCT/GB2021/053164
§ 371 (c)(1),
(2) Date: Jun. 20, 2023

(87) PCT Pub. No.: WO2022/136825
PCT Pub. Date: Jun. 30, 2022

(65) Prior Publication Data

US 2024/0065404 A1 Feb. 29, 2024

(30) Foreign Application Priority Data

Dec. 22, 2020 (GB) ..... 2020344

(51) Int. Cl.
*A45D 2/36* (2006.01)
*A45D 20/50* (2006.01)

(52) U.S. Cl.
CPC ..... *A45D 2/367* (2013.01); *A45D 20/50* (2013.01)

(58) Field of Classification Search
CPC ..... A45D 20/12; A45D 20/122; A45D 20/26; A45D 20/50
See application file for complete search history.

(56) References Cited

U.S. PATENT DOCUMENTS 2,827,060 A 3/1958 Marty
4,097,722 A 6/1978 Soler et al.
(Continued)

FOREIGN PATENT DOCUMENTS

CN 1061901 A 6/1992
CN 1123002 A 5/1996
(Continued)

OTHER PUBLICATIONS

Examination Report received for GB Application No. 2020343.6, mailed on Jun. 13, 2023, 1 page.
(Continued)

*Primary Examiner* — Eric J Rosen
*Assistant Examiner* — Sydney J Pulvidente
(74) *Attorney, Agent, or Firm* — Tucker Ellis LLP

(57) ABSTRACT

A haircare appliance has an air inlet, an air outlet, and an airflow generator for generating an airflow from the air inlet to the air outlet. The air outlet has a first aperture at least partially defined by a first movable member, and a second aperture at least partially defined by a second movable member. Each of the first and second movable members are movable to vary a cross-sectional area of the respective first and second apertures, and movement of the first movable member causes movement of second movable member.

22 Claims, 12 Drawing Sheets

(56) References Cited

U.S. PATENT DOCUMENTS

| | | | | |
|---|---|---|---|---|
| 5,212,366 | A | 5/1993 | Mcdougall | |
| 5,546,674 | A * | 8/1996 | Lange | A45D 20/50 34/97 |
| 5,628,333 | A | 5/1997 | Sahm | |
| 5,636,318 | A | 6/1997 | Polaert et al. | |
| 6,053,181 | A | 4/2000 | Ehlhardt et al. | |
| 10,856,638 | B2 | 12/2020 | Paliobeis et al. | |
| 2003/0052115 | A1 | 3/2003 | Leung | |
| 2013/0160316 | A1 | 6/2013 | Hadden | |
| 2015/0265022 | A1 | 9/2015 | Maclaine | |
| 2015/0265024 | A1* | 9/2015 | Maclaine | A45D 20/12 132/271 |
| 2016/0100681 | A1 | 4/2016 | Smal | |
| 2017/0273428 | A1* | 9/2017 | Nicolson | A46B 11/00 |
| 2017/0273430 | A1 | 9/2017 | Heffer et al. | |

FOREIGN PATENT DOCUMENTS

| | | | |
|---|---|---|---|
| CN | 1215979 | A | 5/1999 |
| CN | 101384189 | A | 3/2009 |
| CN | 104055306 | A | 9/2014 |
| CN | 104248205 | A | 12/2014 |
| CN | 104921437 | A | 9/2015 |
| CN | 106061319 | A | 10/2016 |
| CN | 107224084 | A | 10/2017 |
| CN | 107224085 | A | 10/2017 |
| CN | 210747801 | U | 6/2020 |
| DE | 3824785 | A1 | 2/1990 |
| DE | 4236036 | A1 | 4/1994 |
| DE | 202020003366 | U1 | 8/2020 |
| DE | 202020003367 | U1 | 8/2020 |
| DE | 202020003368 | U1 | 8/2020 |
| DE | 202020003369 | U1 | 8/2020 |
| EP | 0482906 | A1 | 4/1992 |
| EP | 0672871 | A1 | 9/1995 |
| EP | 2773237 | B1 | 12/2019 |
| FR | 0643562 | A | 9/1928 |
| GB | 2526768 | A | 12/2015 |
| GB | 2548819 | A | 10/2017 |
| GB | 2598925 | A | 3/2022 |
| GB | 2624338 | A | 5/2024 |
| JP | 59-027702 | U | 2/1984 |
| JP | 59-197209 | A | 11/1984 |
| KR | 101453723 | B1 | 10/2014 |
| WO | 2008132345 | A2 | 11/2008 |
| WO | 2014/060611 | A1 | 4/2014 |
| WO | 2014/112260 | A1 | 7/2014 |
| WO | 2015/140506 | A1 | 9/2015 |
| WO | 2015/190217 | A1 | 12/2015 |
| WO | 2017/163066 | A1 | 9/2017 |
| WO | 2020109751 | A1 | 6/2020 |
| WO | 2022/136825 | A1 | 6/2022 |
| WO | 2022/136826 | A1 | 6/2022 |

OTHER PUBLICATIONS

Examination Report received for GB Application No. 2020344.4, mailed on Jun. 14, 2023, 1 page.
Search Report received for GB Application No. 2020340.2, mailed on May 6, 2021, 1 page.
Search Report received for GB Application No. 2020341.0, mailed on May 7, 2021, 1 page.
Search Report received for GB Application No. 2020342.8, mailed on May 25, 2021, 2 pages.
Search Report received for GB Application No. 2020343.6, mailed on May 25, 2021, 1 page.
Search Report received for GB Application No. 2020344.4, mailed on May 26, 2021, 2 pages.
Examination Report received for GB Application No. 2020342.8, mailed on Jun. 12, 2023, 3 pages.
International Search Report and Written Opinion received for PCT Patent Application No. PCT/GB2021/052879, mailed on Feb. 23, 2022, 9 pages.
International Search Report and Written Opinion received for PCT Patent Application No. PCT/GB2021/053164, mailed on Mar. 17, 2022, 10 pages.
International Search Report and Written Opinion received for PCT Patent Application No. PCT/GB2021/053165, mailed on Mar. 18, 2022, 9 pages.
International Search Report and Written Opinion received for PCT Patent Application No. PCT/GB2021/053166, mailed on Mar. 18, 2022, 9 pages.
International Search Report and Written Opinion received for PCT Patent Application No. PCT/GB2021/053250, mailed on Feb. 23, 2022, 10 pages.

* cited by examiner

HAIRCARE APPLIANCE

CROSS-REFERENCE TO PRIOR APPLICATION

This application is a § 371 National Stage Application of PCT International Application No. PCT/GB2021/053164 filed Dec. 3, 2021, which claims the priority of United Kingdom Application No. 2020344.4, filed Dec. 22, 2020, each of which are herein incorporated by reference in their entirety.

FIELD OF THE INVENTION

The present invention relates to a haircare appliance, and an attachment for a haircare appliance.

BACKGROUND OF THE INVENTION

Haircare appliances are generally used to treat or style hair, and some haircare appliances may treat or style hair using airflow. To provide versatility in treating and styling hair some haircare appliances provide airflow at a variable flow rate.

SUMMARY OF THE INVENTION

According to a first aspect of the present invention there is provided an attachment for a haircare appliance comprising an air inlet for receiving an airflow, and an air outlet for emitting airflow, wherein the air outlet comprises a first aperture at least partially defined by a first movable member, and a second aperture at least partially defined by a second movable member, each of the first and second movable members movable to vary a cross-sectional area of the respective first and second apertures, wherein movement of the first movable member causes movement of second movable member.

The attachment according to the first aspect of the present invention may be beneficial as each of the first and second movable members are movable to vary a cross-sectional area of the respective first and second apertures, and movement of the first movable member causes movement of second movable member. In particular, movement of the first movable member to vary the cross-sectional area of the first aperture may cause movement of the second movable member to vary the cross-sectional area of the second aperture. This may enable automatic adjustment of the second aperture in response to adjustment of the first aperture.

Use of movable members to vary the cross-sectional area of the first and second apertures may enable characteristics of airflow provided through the first and second apertures to be varied, for example by providing diffuse or concentrated airflow dependent on the cross-sectional area of the aperture in question.

Movement of the second movable member may cause movement of the first movable member. This may enable automatic adjustment of the cross-sectional area of the first aperture in response to adjustment of the cross-sectional area of the second aperture. Movement of the second movable member to vary the cross-sectional area of the second aperture may cause movement of the first movable member to vary the cross-sectional area of the first aperture.

The attachment may comprise a central axis, for example a central longitudinal axis, the first and second movable members may be located on opposing sides of the central axis, and the first and second apertures may be located on opposing sides of the central axis. This may enable provision of airflow from one side of the attachment to be modified in response to a modification made to provision of airflow from the other, opposing, side of the attachment. For example, movement of the first movable member to vary the cross-sectional area of the first aperture on a first side of the attachment may cause movement of the second movable member to vary the cross-sectional area of the second aperture on a second, opposing side of the attachment.

The first and second movable members may be located on opposing sides of a plane containing the central axis, and the first and second apertures may be located on opposing sides of the plane.

Movement of the first movable member in a direction may cause movement of second movable member in the same direction. This may be beneficial as it may enable reciprocating motion of the first and second movable members.

The first and second movable members may be movable in a direction substantially orthogonal to an outer surface of the attachment, for example in a direction away from and/or toward the attachment. The first and second movable members may be movable in a direction tangential to the outer surface of the attachment, for example in a direction along an outer periphery of the attachment. The first and second movable members may be linearly movable. The first and second movable members may be rotationally movable. The first and second movable members may be movable in at least two planes of motion.

Movement of the first movable member in a first direction may increase the cross-sectional area of the first aperture, movement of the second movable member in the first direction may decrease the cross-sectional area of the second aperture, movement of the first movable member in a second direction opposite to the first direction may decrease the cross-sectional area of the first aperture, and movement of the second movable member in the second direction may increase the cross-sectional area of the second aperture. This may enable selective provision of a greater amount of airflow from the first aperture relative to the second aperture, or vice versa.

This may be particularly beneficial where the first and second apertures are located on opposing sides of the attachment. For example, increasing a cross-sectional area of an aperture on a first side of the attachment may decrease a cross-sectional area of an aperture on a second, opposing, side of the attachment. This may enable a greater volume of airflow to be provided on one side of the attachment relative to the other side of the attachment in use, which may provide increased efficiency, for example with less wasted airflow directed away from hair in use, and may provide increased styling control with airflow primarily directed only in a desired direction in use, thereby decreasing the risk of stray airflow affecting a styling process.

Movement of the first and second movable members may be constrained such that the first and second apertures comprise respective maximal and minimal cross-sectional areas at boundaries of motion of the first and second movable members. This may ensure that, for example, displacement of the first and second movable members at maximal distances relative to other components of the attachment provides maximal and minimal cross-sectional areas for the first and second apertures and, for example, maximal and minimal airflow through the first and second apertures for a given flow rate of the airflow generator.

The first aperture may comprise its maximal cross-sectional area when the second aperture comprises its minimal cross-sectional area, and the first aperture may comprise its minimal cross-sectional area when the second aperture comprises its maximal cross-sectional area. This may enable selective provision of a greater amount of airflow from the first aperture relative to the second aperture, or vice versa.

Airflow through the first and second apertures may be fully inhibited when the first and second apertures comprise their minimal cross-sectional areas, for example such that no airflow passes through the first or second apertures when they comprise their minimal cross-sectional areas. The minimal cross-sectional area may be zero. This may enable a greater volume of airflow to be provided through one aperture relative to the other aperture, which may provide increased efficiency, for example with less wasted airflow directed through an unused aperture in use, and may provide increased styling control with airflow primarily directed only in a desired direction in use, thereby decreasing the risk of stray airflow affecting a styling process.

The first and second movable members may be biased to a rest configuration in use, and the first and second apertures may comprise cross-sectional areas intermediate their maximal and minimal cross-sectional areas when the first and second movable members are in their respective rest configurations. This may, for example, enable airflow to pass through both the first and second apertures in the rest configuration, before increasing airflow through one of the first and second apertures and decreasing airflow through the other of the second and first apertures when the movable members are moved in use. The first and second movable members may be biased to the rest configuration in the absence of engagement of hair with the attachment.

The first and second movable members may be biased to the rest configuration by airflow flowing through the attachment in use. This may ensure that airflow is able to pass through both the first and second apertures in the rest configuration. The first and second movable members may be biased to the rest configuration by airflow flowing at a flow rate greater than a pre-determined threshold. The first and second movable members may be located such that the first and second apertures comprise their minimal cross-sectional area in the absence of airflow flowing through the attachment.

The airflow generator may be configured to generate an airflow from the air inlet to the air outlet at an airflow rate greater than 4 L/s, greater than 6 L/s, greater than 8 L/s, greater than 10 L/s, greater than 12 L/s, or greater than 14 L/s.

The first and second movable members may be biased to the rest configuration against the force of a biasing member. This may ensure that the movable members move away from the rest configuration in the absence of an airflow flowing from the air inlet to the air outlet in use. The biasing member may comprise a plurality of biasing members, for example at least one biasing member per movable member. The biasing member may comprise a resiliently deformable member, such as a spring.

The first and second movable members may be movable in response to the attachment engaging hair in use. This may enable automatic variation of the cross-sectional area of the first and second apertures in response to the attachment engaging hair in use, for example without requiring user interaction to manually vary the cross-sectional area of the first and second apertures.

The first and second movable members may each comprise a plurality of bristles, and the first and second movable members may be movable in response to the bristles engaging hair in use. This may provide a simple actuation mechanism for movement of the first and second movable members, for example with forces applied to the bristles by engagement with hair and/or relative movement of the bristles to the hair causing movement of the first and second movable members.

The first and second movable members may move such that the cross-sectional area of the respective first and second apertures increase when the bristles of the respective first and second movable members engage hair in use. This may ensure that airflow is increased in the region of the movable member which is engaged with the hair, whilst airflow is decreased in the region of the movable member on the opposite side of the attachment to the movable member which is engaged with the hair. This may enable a greater volume of airflow to be provided through one aperture relative to the other aperture, which may provide increased efficiency, for example with less wasted airflow directed through an unused aperture in use, and may provide increased styling control with airflow primarily directed only in a desired direction in use, thereby decreasing the risk of stray airflow affecting a styling process.

Movement of the first movable member to increase the cross-sectional area of the first aperture may decrease an internal air pressure of the attachment in use, and the decrease in internal air pressure may cause movement of the second movable member to decrease the cross-sectional area of the second aperture. This may provide an automatic mechanism for decreasing the cross-sectional area of the second aperture in response to increasing the cross-sectional area of the first aperture, or vice versa. For example, an internal air pressure of the attachment may be sufficient to bias the first and second movable members such that the first and second apertures comprise the same cross-sectional area, whilst movement of the first movable member to increase the cross-sectional area of the first aperture may decrease the internal air pressure of the attachment. Such a decrease in internal air pressure may mean that the internal air pressure is no longer sufficient to retain the second movable member in its initial position, and so the second movable member may move to decrease the cross-sectional area of the second aperture in response to the decrease in internal air pressure of the attachment.

Movement of the first movable member may cause the first movable member to contact and cause movement of the second movable member. Movement of the second movable member may cause the second movable member to contact and cause movement of the first movable member. Such physical contact between the first and second movable members may provide a reliable way of causing motion of the other of the second and first movable members in use. The first or second movable member may rotate about a periphery of the attachment to contact the other of the second or first movable member.

The first and second movable members may be linked by at least one mechanical link. Such a mechanical link may ensure that movement of the first movable member causes movement of the second movable member, and vice versa. The mechanical link may enable reciprocal motion of the first and second movable members. The first and second movable members may be directly linked by at least one mechanical link, or indirectly linked by at least one mechanical link.

The at least one mechanical link may be resiliently deformable such that movement of the first movable member causes movement of the second movable member, or vice versa. This may, for example, ensure that the first and second movable members can return to their original positions in the absence of an applied force in use. Deformation of the at least one mechanical link in response to movement of the first movable member in a first direction may cause movement of the second movable member in the first direction.

The attachment may comprise a third movable member, the first, second and third movable members may be spaced about a periphery of the attachment, and adjacent movable members may be linked by a mechanical link. In such a manner movement of any of the movable members may impact on any combination of the other movable members.

Each movable member may be linked to the other movable members by a continuous mechanical link. Use of a continuous mechanical link may reduce component count and/or cost compared to a similar arrangement that utilises a plurality of discrete mechanical links, and may reduce a risk of failure in use.

The attachment may comprise a fixed member, the first and second movable members may be movable relative to the fixed member, and the fixed member may at least partially define the first and second apertures. This may be beneficial as it may enable definition of the first and second apertures using only one movable member per aperture, which may reduce a risk of failure in use. The attachment may comprise first and second fixed members, each fixed member at least partially defining a corresponding one of the first and second apertures.

Each movable member may be located intermediate adjacent fixed members such that each movable member at least partially defines a plurality of apertures. For example the first movable member may be located between the first and second fixed members such that the first movable member and the first fixed member define the first aperture, and the first movable member and the second fixed member define a third aperture. Movement of the first movable member in a first direction may increase the cross-sectional area of the first aperture whilst decreasing a cross-sectional area of the third aperture, and movement of the first movable member in a second direction opposite to the first direction may increase the cross-sectional area of the third aperture whilst decreasing the cross-sectional area of the first aperture. In such a manner a cross-sectional area of an aperture may be increased upon movement of a movable member in either of two directions.

The second movable member may be located between the first and second fixed members such that the second movable member and the second fixed member define the second aperture, and the second movable member and the first fixed member define a fourth aperture. Movement of the second movable member in a first direction may increase the cross-sectional area of the second aperture whilst decreasing a cross-sectional area of the fourth aperture, and movement of the second movable member in a second direction opposite to the first direction may increase the cross-sectional area of the fourth aperture whilst decreasing the cross-sectional area of the second aperture.

Movement of the first movable member to increase the cross-sectional area of either the first or third apertures may cause movement of the second movable member to decrease the cross-sectional area of both of the second and fourth apertures. Movement of the second movable member to increase the cross-sectional area of either the second or fourth apertures may cause movement of the first movable member to decrease the cross-sectional area of both of the first and third apertures.

The fixed member may be shaped such that airflow through the first and second apertures comprises a component tangential to the attachment. This may provide increased control over styling using the attachment compared to, for example, a attachment that provides airflow through the first and second apertures in a solely radial direction, as hair may typically extend in a tangential direction relative to the attachment in use to obtain greater hair coverage and reduced drying and/or styling times.

The first and second fixed members may be shaped such that airflow through the first and third apertures moves in substantially opposing directions. The first and second fixed members may be shaped such that airflow through the second and fourth apertures moves in substantially opposing directions. This may enable airflow to be provided in different directions depending upon the direction in which the attachment is moved relative to hair in use.

The attachment may comprise at least three movable members and at least three fixed members.

According to a second aspect of the present invention there is provided a haircare appliance comprising an air inlet, an air outlet, and an airflow generator for generating an airflow from the air inlet to the air outlet, wherein the air outlet comprises a first aperture at least partially defined by a first movable member, and a second aperture at least partially defined by a second movable member, each of the first and second movable members are movable to vary a cross-sectional area of the respective first and second apertures, and movement of the first movable member causes movement of second movable member.

The haircare appliance may comprise a handle unit within which the airflow generator is disposed, and an attachment comprising the air outlet and the first and second movable members, the attachment removably attachable to the handle unit. Providing the air outlet described above as part of a removable attachment may allow the functionality described herein to be selectively provided by a user.

The haircare appliance may comprise a heater to heat the airflow generated by the airflow generator in use.

Optional features of aspects of the present invention may be equally applied to other aspects of the invention, where appropriate.

DETAILED DESCRIPTION OF THE INVENTION

Figure 1:
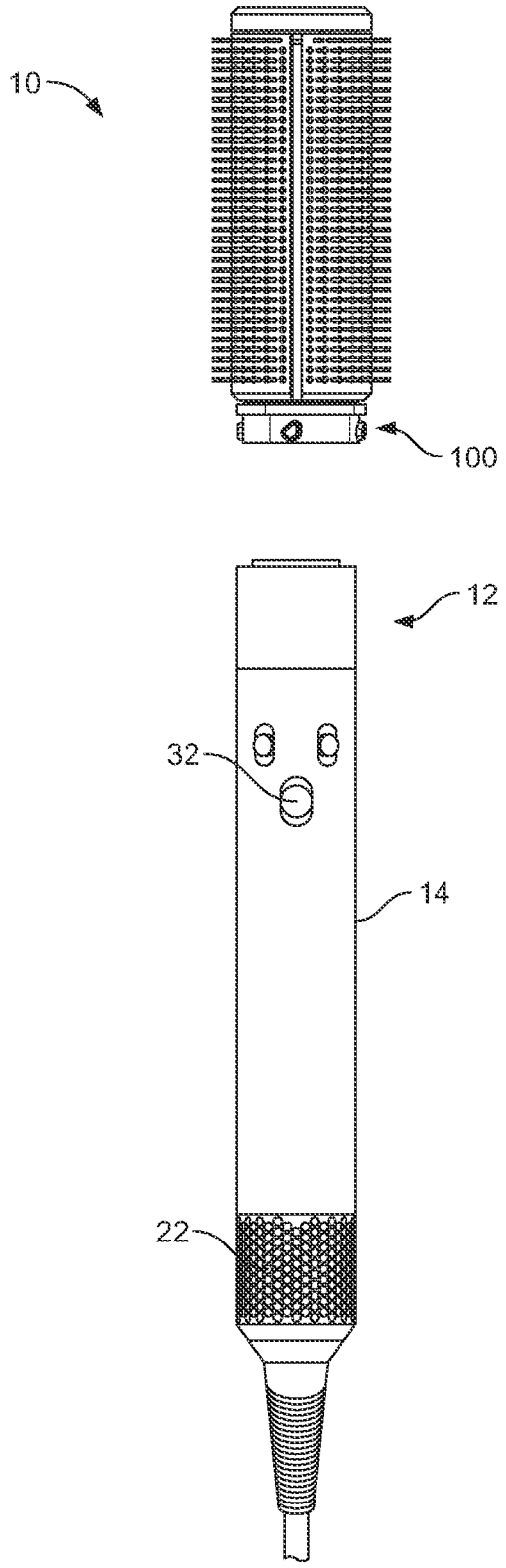
FIG. 1 is a schematic view illustrating a haircare appliance according to the present invention.

A haircare appliance according to the present invention, generally designated 10, is shown schematically in FIG. 1.

The haircare appliance 10 comprises a handle unit 12, and an attachment 100 removably attachable to the handle unit 12.

Figure 2:
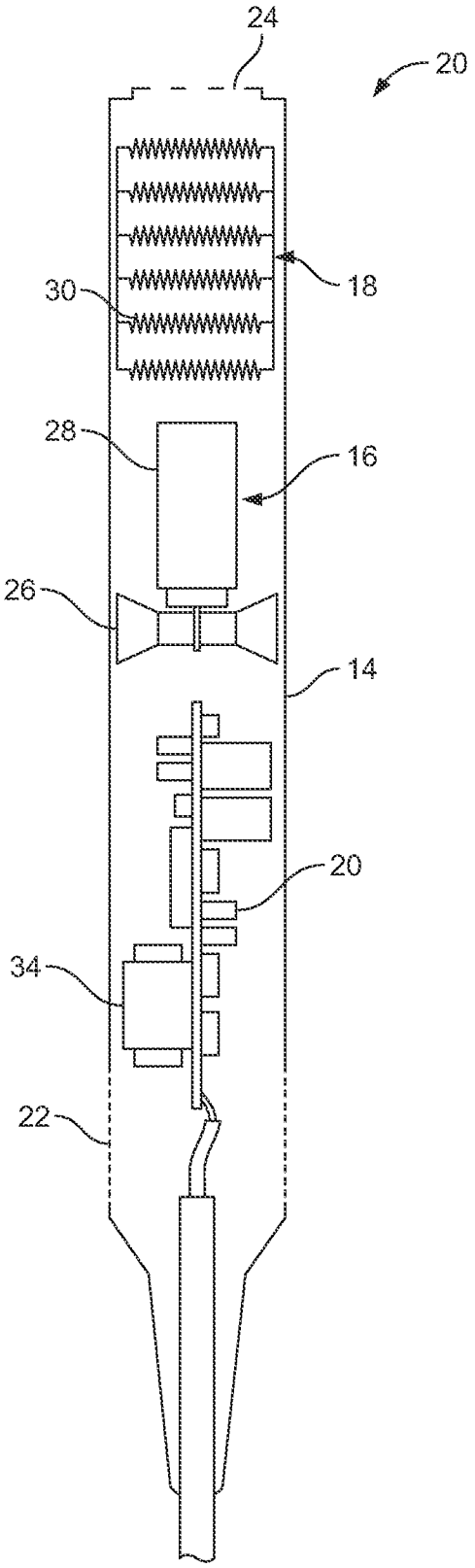
FIG. 2 is a schematic cross-sectional view through a handle unit of the haircare appliance of FIG. 1.
Figure 3:
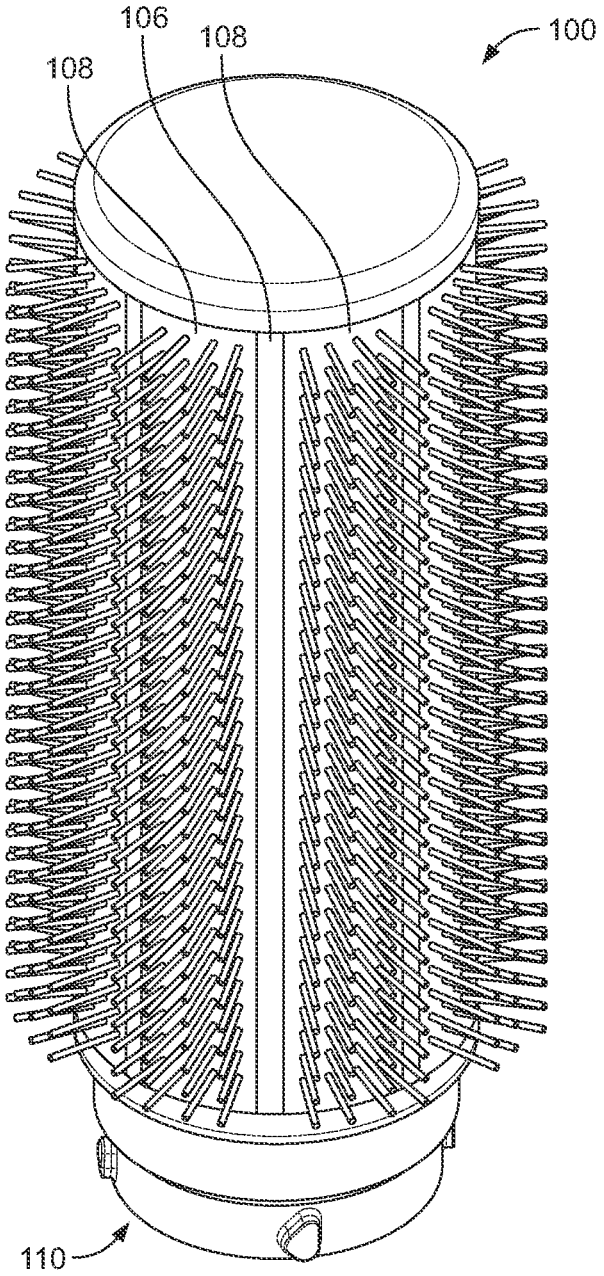
FIG. 3 is a schematic perspective view of a first embodiment of an attachment for the haircare appliance of FIG. 1.
Figure 4:
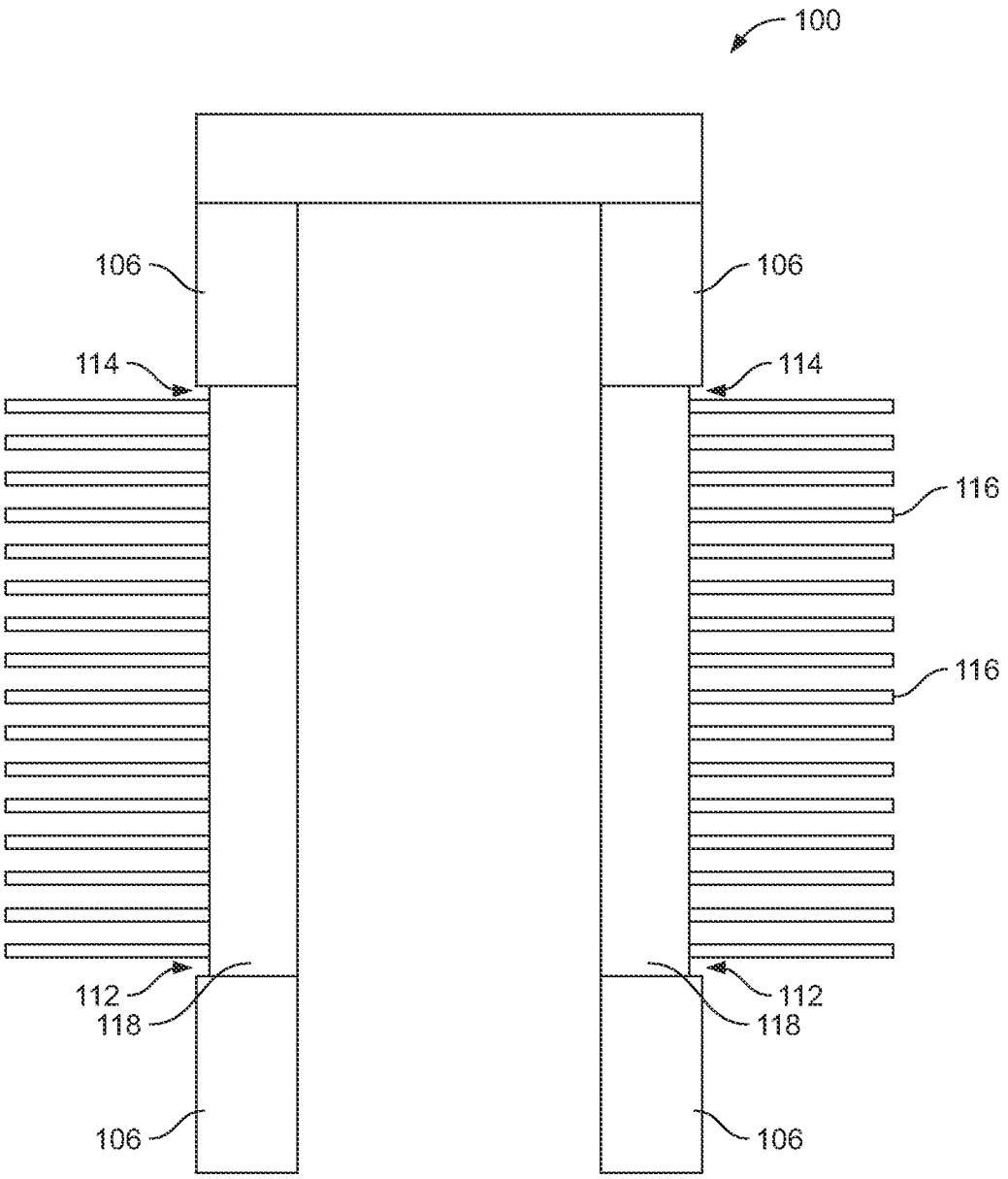
FIG. 4 is a schematic longitudinal cross-section of the attachment of FIG. 3.

The handle unit 12 comprises a housing 14, an airflow generator 16, a heater 18, and a control unit 20, as can be seen schematically in FIG. 2.

The housing 14 is tubular in shape, and comprises an air inlet 22 through which an airflow is drawn into the housing 14 by the airflow generator 16, and an air outlet 24 through which the airflow is discharged from the housing 14. The airflow generator 16 is housed within the housing 14, and comprises an impeller 26 driven by an electric motor 28. The heater 18 is also housed within the housing 14, and comprises heating elements 30 to optionally heat the airflow.

The control unit 20 comprises electronic circuitry for a user interface 32 and a control module 34. The user interface 32 is provided on an outer surface of the housing 14, and is used to power on and off the haircare appliance 10, to select a flow rate (for example high, medium and low), and to select an airflow temperature (for example hot, medium or cold). In the example of FIG. 1, the user interface comprises a plurality of sliding switches, but other forms of user interface 32, for example buttons, dials or touchscreens, are also envisaged.

The control module 34 is responsible for controlling the airflow generator 16, and the heater 18 in response to inputs from the user interface 32. For example, in response to inputs from the user interface 32, the control module 34 may control the power or the speed of the airflow generator 16 in order to adjust the airflow rate of the airflow, and the power of the heater 18 in order to adjust the temperature of the airflow.

The attachment 100 is shown schematically in FIGS. 3 to 6. The attachment 100 comprises a main body 106, and a plurality of bristle beds 108.

The main body 106 is generally cylindrical in form, and is open at one end and closed at the other end. The open end serves as an inlet 110 into the main body 106. The main body 106 has a plurality of slots 112 within which the bristle beds 108 are mounted, with movement of the bristle beds 108 within the slots 112 causing air outlets 114 of the attachment 100 to be selectively opened between longitudinal edges of the bristle beds 108 and the slots 112, as will be discussed hereafter. Each air outlet 114 may be thought of as an aperture defined between the bristle bed 108 and the adjacent portion of the main body 106.

The bristle beds 108 may be thought of as movable members of the attachment 100, and each comprises a plurality of bristles 116 upstanding from a body portion 118. As can be seen from FIG. 5, each body portion 118 of a bristle bed 108 is shaped to conform to adjacent portions of the main body 106. This means that when the body portion 118 of a bristle bed 108 contacts adjacent portions of the main body 108, the air outlets 114 that are selectively defined by that bristle bed 108 are closed, such that substantially no airflow can pass through the air outlets 114.

The bristle beds 108 are thicker than the adjacent portions of the main body 106, such that innermost regions of the bristle beds 108 extend radially inwardly of innermost regions of the main body 106 when the body portion 118 is fully engaged with the main body 106, for example when the air outlets 114 are fully closed. Each bristle bed 108 is attached to an adjacent bristle bed 108 about the periphery of the attachment by a spring 120, with each spring 120 extending between radially innermost portions of the bristle beds 108. Although shown here as a single spring 120 connecting adjacent bristle beds 108, it will be appreciated that in practice multiple springs may be used to connect adjacent bristle beds 108, for example with springs spaced apart along a longitudinal extent of the bristle beds. Use of multiple springs may provide even opening of the air outlets 114 in use.

Figure 5:
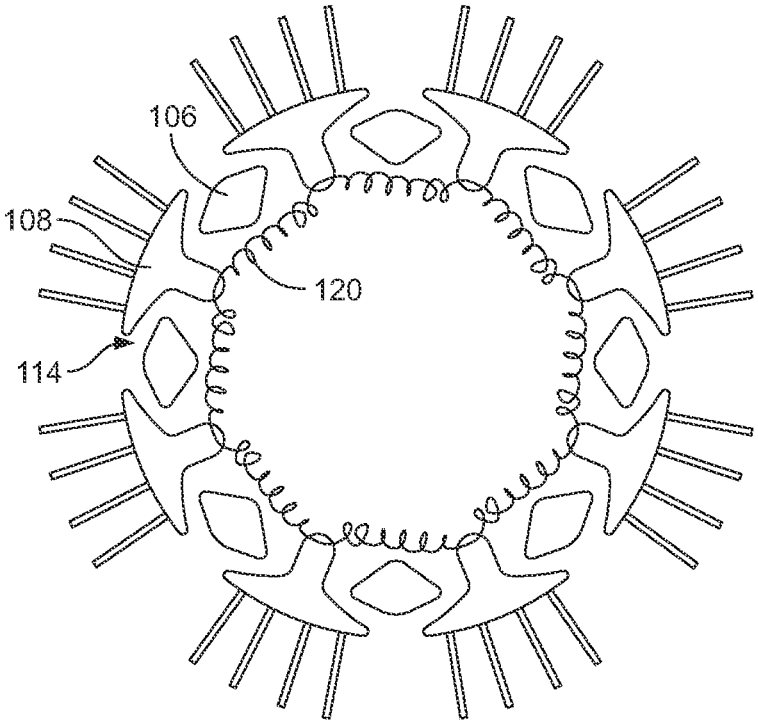
FIG. 5 is a schematic illustration of the attachment of FIG. 3 in a rest configuration.

As illustrated in FIG. 5, when airflow flows through the attachment 100 in use, and when the attachment 100 is not engaged with hair, the internal air pressure of the attachment biases the bristle beds 108 radially outwardly from the main body 106 into a rest configuration, such that each air outlet 114 is opened by a small amount. In such a rest configuration diffuse airflow may be provided about the periphery of the attachment through each air outlet 114.

Figure 6:
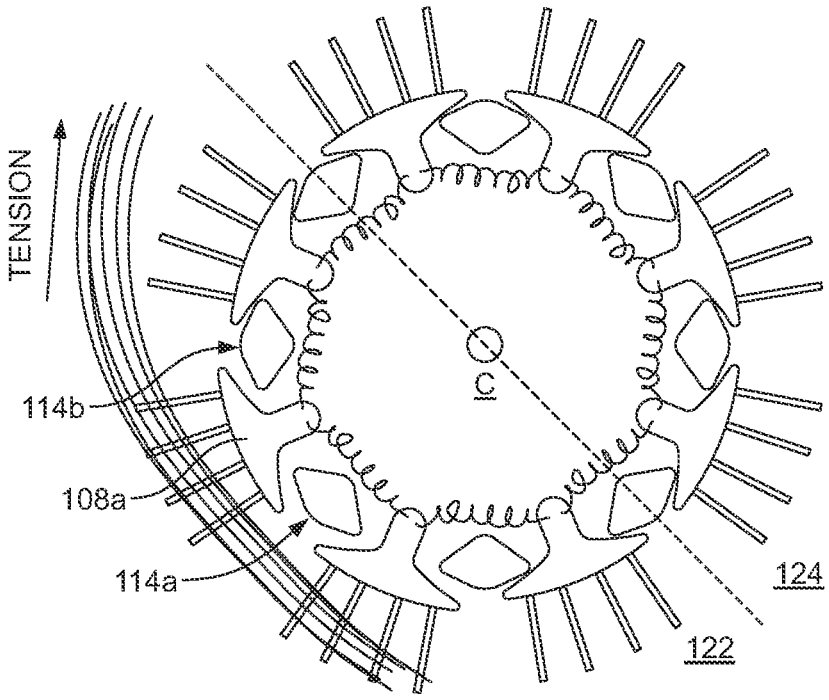
FIG. 6 is a schematic illustration of the attachment of FIG. 3 engaged with hair in use.

When bristles 116 of a bristle bed 108 engage with hair in use, as illustrated in FIG. 6, the force applied to the bristle bed 108 via the engagement with, and relative movement to, hair pulls that bristle bed 108 to move the bristle bed 108 within the slot 112, thereby varying a cross-sectional area of the air outlets 114 defined by that bristle bed 108. For example, in FIG. 6 a cross-sectional area of a first air outlet 114*a* defined by a first bristle bed 108*a* is increased in response to engagement with hair and relative movement in a first direction, whilst a cross-sectional area of a second air outlet 114*b* defined by the first bristle bed 108*a* is decreased in response to engagement with hair and relative movement in the first direction. In such a manner an increased amount of airflow may pass through the first air outlet 114*a* in response to engagement of the first bristle bed 108 with hair in use. It will of course be appreciated that engagement with hair and relative motion in a second direction opposite to the first direction will decrease the cross-sectional area of the first air outlet 114*a* whilst increasing the cross-sectional area of the second air outlet 114*b*.

The bristle beds 108 are movable within the slots 112 in response to engagement of hair with the attachment 100 such that movement of the bristle beds occurs in both a radial and a circumferential direction. This may provide greater flexibility of motion compared to either radial or circumferential motion alone.

As previously mentioned, each of the bristle beds 108 is linked to adjacent bristle beds 108 by a spring 120. Thus movement of one bristle bed 108 relative to the main body 106 also causes movement of the other bristle beds 108 relative to the main body 106. In particular, and as seen in FIG. 6, where bristle beds 108 are engaged with hair in use to move and increase a cross-sectional area of air outlets 114 defined by those bristle beds 108, bristle beds 108 not in contact with hair move within their slots 112 to close their corresponding air outlets 114. As can be seen, opposing bristle beds 108 move in the same direction in response to engagement of one of the bristle beds 108 with hair, for example with one bristle bed 108 being pulled by hair and an opposing bristle bed 108 being pulled in the same direction by the springs 108.

Thus air outlets 114 on a first side 122 of the attachment 100 engaged with hair in use may experience an increase in cross-sectional area, whilst air outlets 114 on a second side 124 of the attachment 100 not engaged with hair in use may experience a decrease in cross-sectional area, with air outlets 114 on the second side 124 of the attachment 100 being closed in response to an increase in cross-sectional area of air outlets 114 on a first opposing side 122 of the attachment 100. This may enable a greater volume of airflow to be provided through one side of the attachment 100 relative to the other opposing side of the attachment 100, which may provide increased efficiency, for example with less wasted airflow directed away from hair in use, and may provide increased styling control with airflow primarily directed only in a desired direction in use, thereby decreasing the risk of stray airflow affecting a styling process. The first 122 and second 124 sides of the attachment 100 are located on opposite sides of a central longitudinal axis C of the attachment 100.

The springs 120 return the bristle beds 108 to the rest configuration when disengaged from hair in use. An increase in cross-sectional area of an air outlet 114 may also reduce an internal air pressure of the main body 106, which may assist in moving the bristle beds 108 not in contact with hair to close their corresponding air outlets 114 under the action of the springs 120.

As seen in FIG. 6, the slots 112 in the main body 106, and the bristle beds 108, are shaped such that airflow through the air outlets 114 in use is in a direction having a tangential as well as a radial component. This may assist in directing airflow along a length of hair in use, which may provide increased efficiency and decreased dry times.

In the embodiment of FIGS. 3 to 6, motion of any of the bristle beds 108 causes motion of the other bristle beds 108 to selectively open and close air outlets 114 of the attachment 100. In a slight modification of the attachment 100 of FIGS. 3 to 6, each bristle bed 108 may be attached to a central column of the main body 106 by one of the springs 120. In such a modified version, a decrease in internal pressure of the attachment 100 caused by movement of a bristle bed 108 to increase a cross-sectional area of an air outlet 114 on one side of the attachment 100 may assist in moving the bristle beds 108 not in contact with hair to close their corresponding air outlets 114 under the action of the springs 120.

Figure 7:
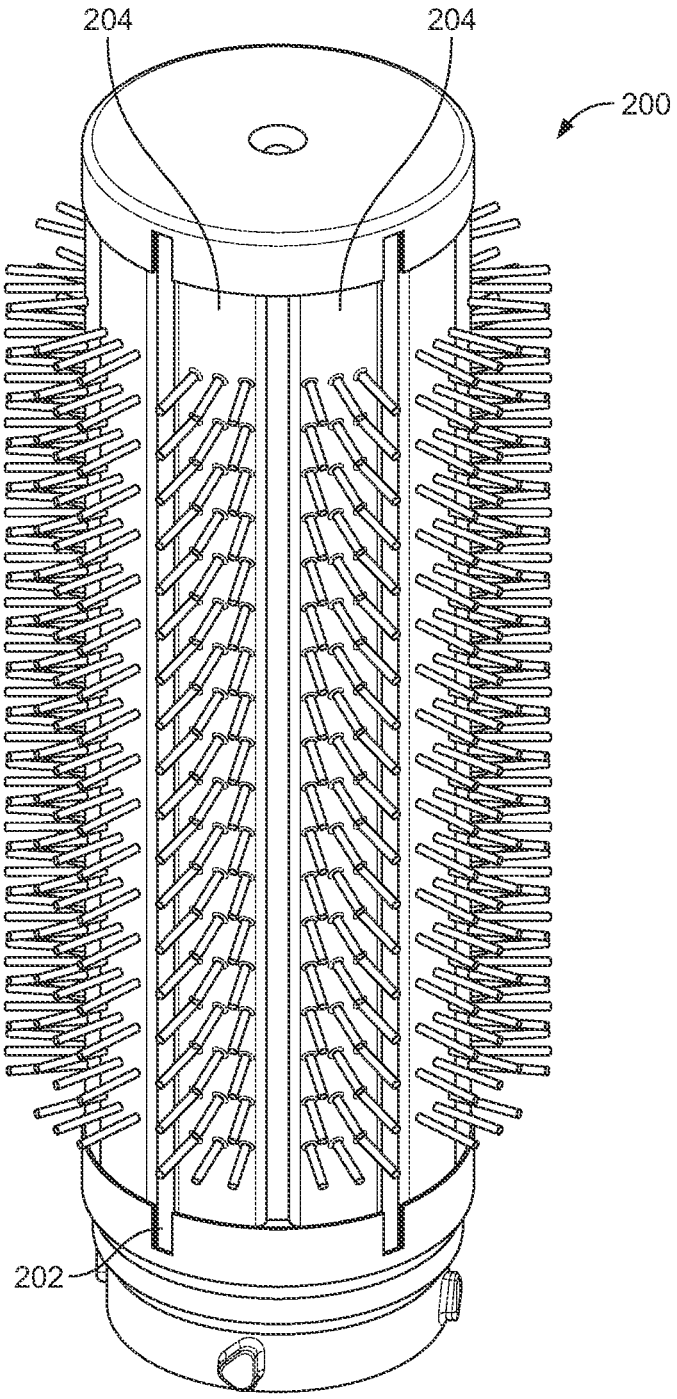
FIG. 7 is a schematic perspective view of a second embodiment of an attachment for the haircare appliance of FIG. 1.
Figure 8:
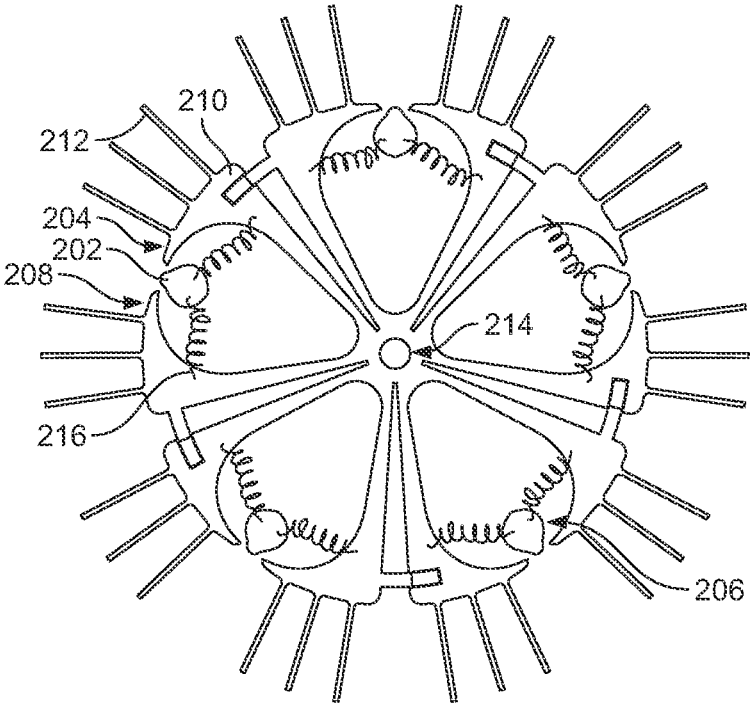
FIG. 8 is a schematic illustration of the attachment of FIG. 7 in a rest configuration.
Figure 9:
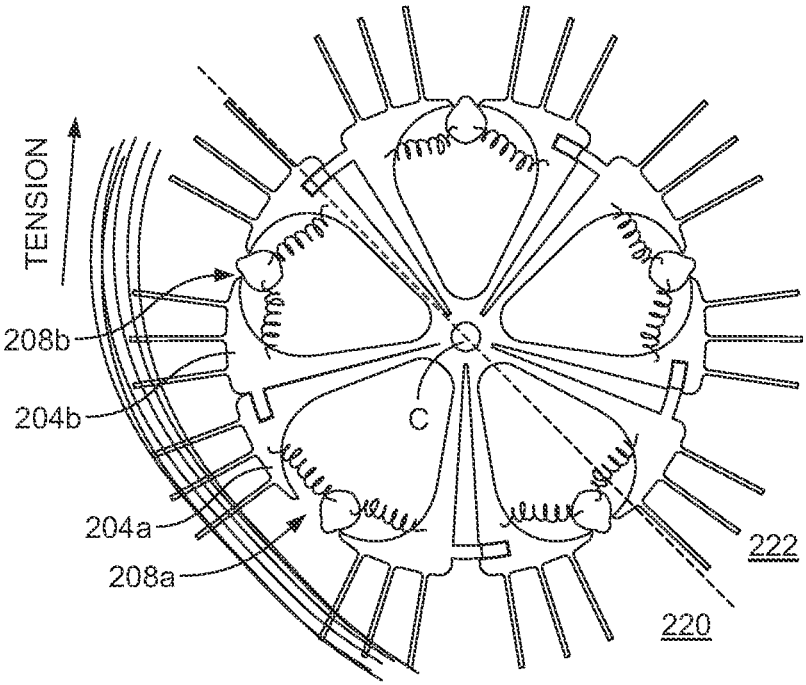
FIG. 9 is a schematic illustration of the attachment of FIG. 7 engaged with hair in use.

A further embodiment of an attachment 200 for use with the handle unit 12 of FIG. 1 is illustrated in FIGS. 7 to 9.

The attachment 200 of FIGS. 7 to 9 is similar to the attachment 100 of FIGS. 3 to 6, in that the attachment of FIGS. 7 to 9 comprises a main body 202 and bristle beds 204 located in slots 206 formed in the main body 202. Here, however, there are two bristle beds 204 located in each slot, with each bristle bed 204 at least partially defining a single air outlet 208 with an adjacent portion of the main body 202.

Each bristle bed 204 comprises a body portion 210 having a generally L-shaped cross-sectional profile, as seen in FIG. 8, with a plurality of bristles 212 extending outwardly from the body portion 210. Each bristle bed 204 either has a projection or a corresponding recess depending on its position within the slot 206.

The main body 202 is generally cylindrical in form, and comprises a central column 214 and the plurality of slots 206. Each bristle bed 204 is pivotable about the central column 214, and each bristle bed 204 is connected to its corresponding adjacent portion of the main body 202 by a spring 216. The springs 216 bias the bristle beds 204 into contact with the corresponding adjacent portions of the main body 202 in the absence of airflow through the attachment 200. Although shown here with springs 216 connecting each bristle bed 204 to its corresponding adjacent portion of the main body 202, embodiments are also envisaged where a compression spring is located between bristle beds 24 in the same slot 206, or where the body portion 210 of the bristle beds 204 is its resiliently deformable to remove the need for the spring 216. The bristle beds 204 are dimensioned such that each bristle bed 204 has a circumferential extent that is less than half of a circumferential extent of the slot 206 within which the bristle bed 204 is disposed. Thus when the bristle beds 204 are biased into contact with the corresponding adjacent portions of the main body 202, a gap exists within adjacent bristle beds 204 within the same slot 206, and each bristle bed 204 within the same slot 206 is movable relative to the other bristle bed 204 in the same slot 206.

As illustrated in FIG. 8, when airflow flows through the attachment 200 in use, and when the attachment 200 is not engaged with hair, the internal air pressure of the attachment biases the bristle beds 204 circumferentially away from the corresponding adjacent portions of the main body 202 into a rest configuration, such that each air outlet 208 is opened by a small amount. In such a rest configuration diffuse airflow may be provided about the periphery of the attachment 200 through each air outlet 208.

When bristles 212 of a bristle bed 204 engage with hair in use, as illustrated in FIG. 9, the force applied to the bristle bed 204 via the engagement with, and relative movement to, hair pulls that bristle bed 204 to move the bristle bed 204 within the slot 206, thereby varying a cross-sectional area of the air outlet 208 defined by that bristle bed 204. Movement of a bristle bed 204 within a slot 206 to increase a cross-sectional area of its air outlet 208 decreases a cross-sectional area of the air outlet 208 defined by the other bristle bed 204 in the same slot 206.

For example, in FIG. 8 a cross-sectional area of a first air outlet **208*a* defined by a first bristle bed 204*a* is increased in response to engagement with hair and relative movement in a first direction, whilst a cross-sectional area of a second air outlet 208*b* defined by a second bristle bed 204*b* in the same slot 206 is decreased in response to engagement with hair and relative movement in the first direction, with the first bristle bed 204*a* contacting the second bristle bed 204*b* to cause such movement. In such a manner an increased amount of airflow may pass through the first air outlet 208*a* in response to engagement of the first bristle bed 204*a* with hair in use. It will of course be appreciated that engagement with hair and relative motion in a second direction opposite to the first direction will decrease the cross-sectional area of the first air outlet 208*a* whilst increasing the cross-sectional area of the second air outlet 204*b***.

The bristle beds 204 are movable within the slots 206 in response to engagement of hair with the attachment 200 such that movement of the bristle beds 204 occurs in a circumferential direction. This may provide a decreased profile for the attachment 200 compared to an attachment with radially outward motion of a bristle bed.

The springs 216 return the bristle beds 204 to the rest configuration when disengaged from hair in use. An increase in cross-sectional area of an air outlet 208 reduces an internal air pressure of the main body 202. Such a decrease in internal air pressure of the main body 202 means that the internal air pressure is no longer sufficient to bias the bristle beds 204 not engaged with hair to the rest configuration.

Thus bristle beds 204 not engaged with hair are moved to close their corresponding air outlet 208 under the action of the springs 216.

Thus an air outlet 208 on a first side 220 of the attachment 200 engaged with hair in use may experience an increase in cross-sectional area, whilst air outlets 208 on a second side 222 of the attachment 200 not engaged with hair in use may experience a decrease in cross-sectional area, with air outlets 208 on the second side 222 of the attachment 200 being closed in response to an increase in cross-sectional area of air outlets 208 on a first opposing side 220 of the attachment 200. This may enable a greater volume of airflow to be provided through one side of the attachment 200 relative to the other opposing side of the attachment 200, which may provide increased efficiency, for example with less wasted airflow directed away from hair in use, and may provide increased styling control with airflow primarily directed only in a desired direction in use, thereby decreasing the risk of stray airflow affecting a styling process. The first 220 and second 222 sides of the attachment 200 are located on opposite sides of a central longitudinal axis C of the attachment 200.

The attachment 200 of FIGS. 7 to 9 is therefore similar to the attachment of FIGS. 3 to 6 in that motion of one bristle bed 204 causes motion of at least one another bristle bed 204 in use.

As seen in FIG. 9, the bristle beds 204, are shaped such that airflow through the air outlets 208 in use is in a direction having a tangential as well as a radial component. This may assist in directing airflow along a length of hair in use, which may provide increased efficiency and decreased dry times.

Figure 10:
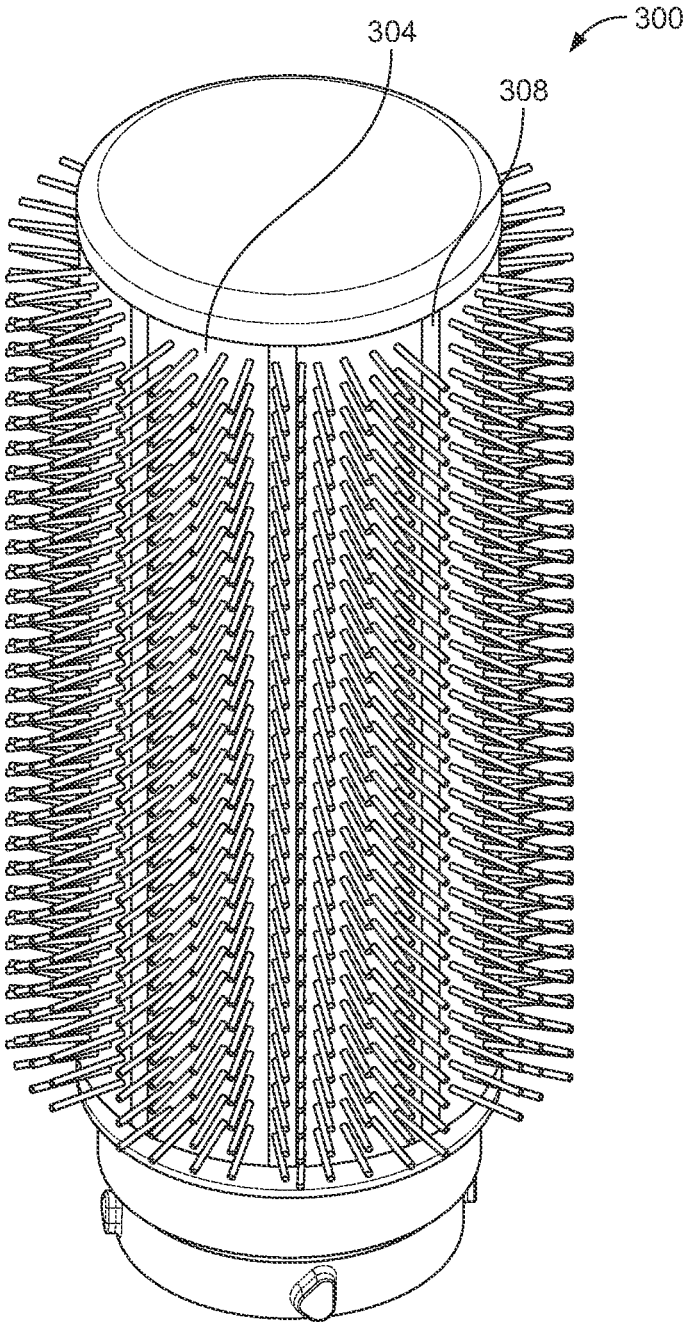
FIG. 10 is a schematic perspective view of a third embodiment of an attachment for the haircare appliance of FIG. 1.
Figure 11:
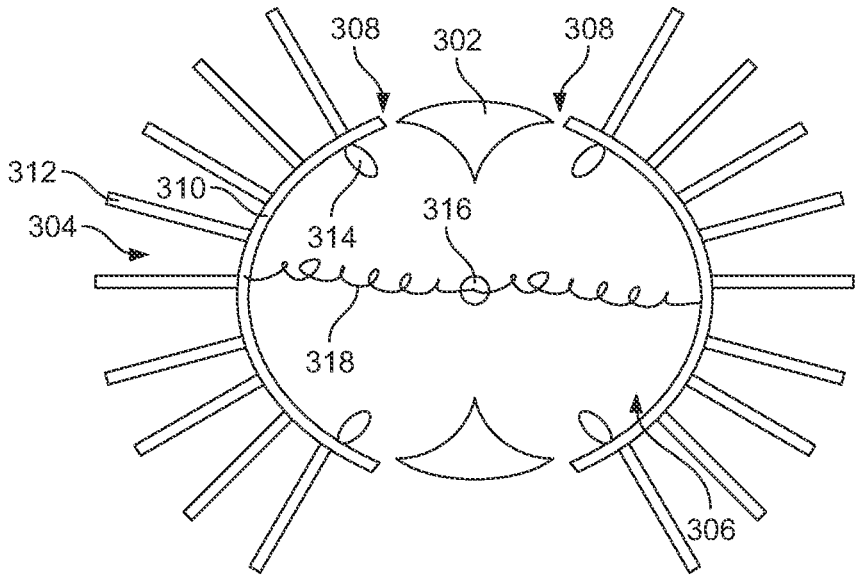
FIG. 11 is a schematic illustration of the attachment of FIG. 10 in a rest configuration.
Figure 12:
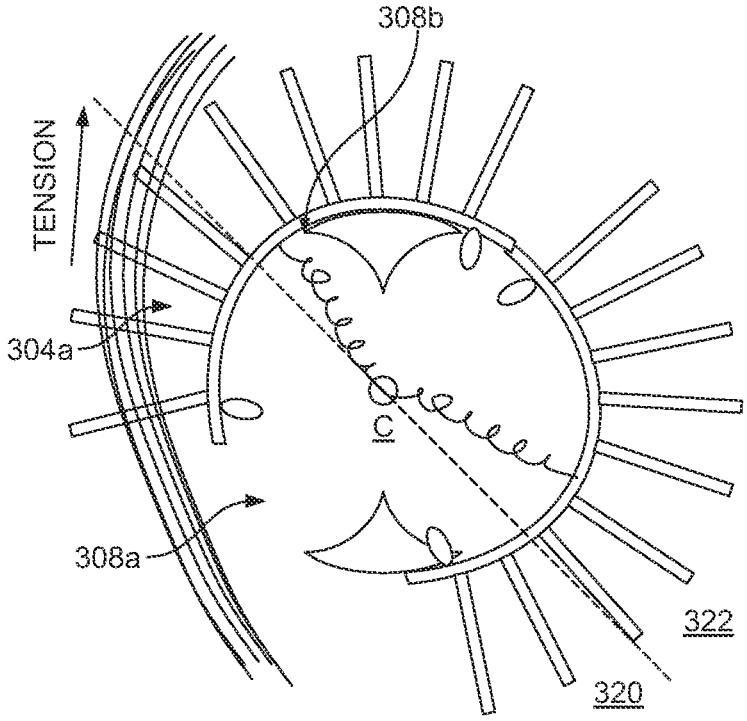
FIG. 12 is a schematic illustration of the attachment of FIG. 10 engaged with hair in use.
Figure 13:
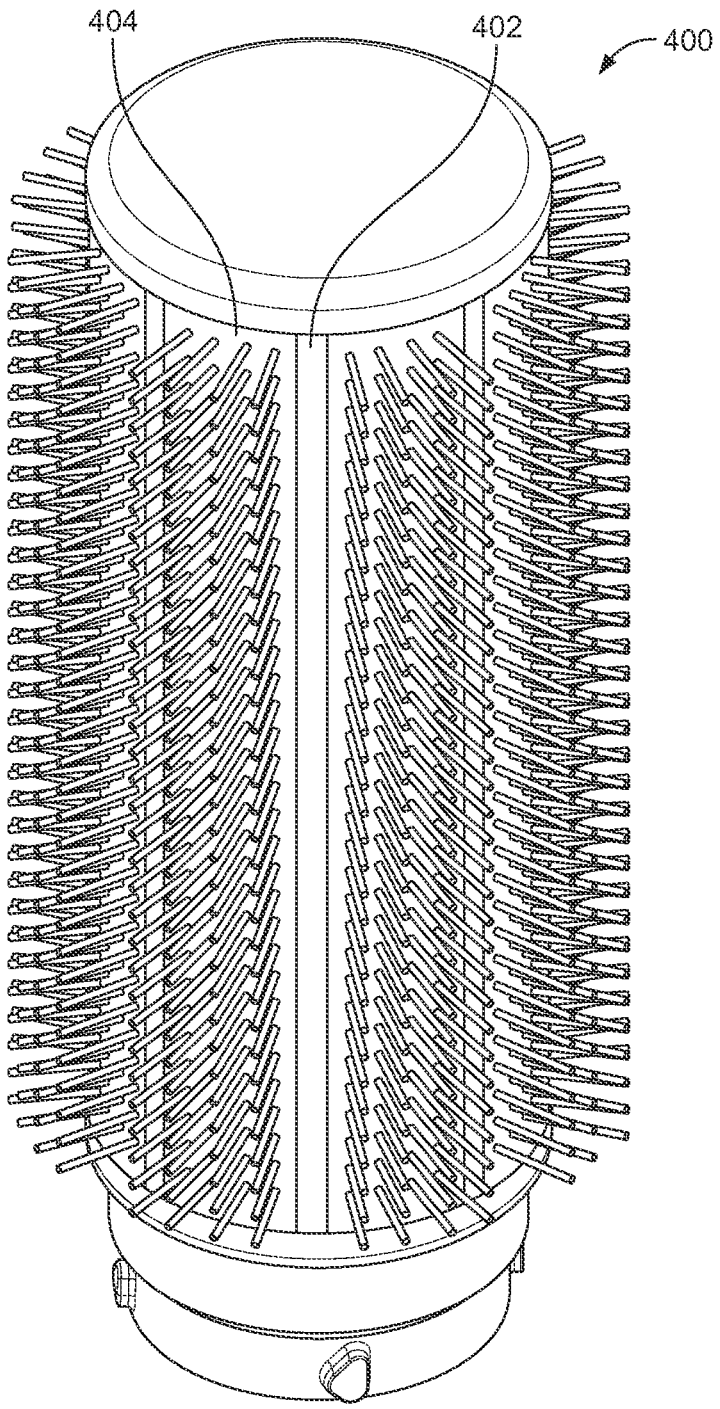
FIG. 13 is a schematic perspective view of a fourth embodiment of an attachment for the haircare appliance of FIG. 1.

A further embodiment of an attachment 300 is illustrated schematically in FIGS. 10 to 12.

The attachment 300 of FIGS. 10 to 12 is similar to the attachment 100 of FIGS. 3 to 6 and the attachment 200 of FIGS. 7 to 9, in that the attachment 300 of FIGS. 10 to 12 comprises a main body 302 and bristle beds 304 located in slots 306 formed in the main body 302. Here, however, each slot 306 is comparatively large, with each slot 306 having a circumferential extent only slightly less than half of a circumferential extent of the main body 302 as a whole, such that there are only two slots 306 with a single bristle bed 304 disposed in each slot 306. Each bristle bed 304, along with an adjacent portion of the main body 302, at least partially defines two air outlets 308.

Each bristle bed 304 comprises a body portion 310 with a plurality of bristles 312 extending outwardly from the body portion 310. The body portion 310 comprises inwardly facing projections 314 for contacting the main body 302 in use, and the inwardly facing projections 314 may control motion of the bristle beds 304 relative to the main body 302.

The main body 302 is generally cylindrical in form, and comprises a central column 316 and the plurality of slots 306. Each bristle bed 304 is connected to the central column 316 by a spring 318, as seen in FIG. 11. Although shown here as one spring 318, it will be appreciated that in practice multiple springs many be used along a length of the bristle bed 304 to provide even motion along the length of the bristle bed 304. The springs 318 bias the respective bristle beds to a rest configuration, illustrated in FIG. 11, in which airflow flows through each of the air outlets 308. In such a rest configuration diffuse airflow may be provided about the periphery of the attachment 300 through each air outlet 308.

When bristles 312 of a bristle bed 304 engage with hair in use, as illustrated in FIG. 12, the force applied to the bristle bed 304 via the engagement with, and relative movement to, hair pulls that bristle bed 304 to move the bristle bed 304 within the slot 306, thereby varying a cross-sectional area of each of the air outlets 308 defined by the bristle bed 304. As seen in FIG. 12, movement of a bristle bed 304 causes the bristle bed 304 to leave the slot 306 and move circumferentially around the periphery of the attachment to the slot 306 on the opposing side of the attachment 300, as will be discussed hereafter.

Movement of a bristle bed 304 within a slot 306 to increase a cross-sectional area of one of the air outlets 308 defined by the bristle bed 304 decreases a cross-sectional area of the other air outlet 308 defined by the bristle bed 304.

For example, in FIG. 12 a cross-sectional area of a first air outlet 308*a* defined by a first bristle bed 304*a* is increased in response to engagement with hair and relative movement in a first direction, whilst a cross-sectional area of a second air outlet 308*b* defined by the same bristle bed 304*a* is decreased in response to engagement with hair and relative movement in the first direction. In such a manner an increased amount of airflow may pass through the first air outlet 308*a* in response to engagement of the first bristle bed 304*a* with hair in use. It will of course be appreciated that engagement with hair and relative motion in a second direction opposite to the first direction will decrease the cross-sectional area of the first air outlet 308*a* whilst increasing the cross-sectional area of the second air outlet 308*b*. The springs 318 return the bristle beds 304 to the rest configuration when disengaged from hair in use.

The bristle beds 304 are movable within the slots 306 in response to engagement of hair with the attachment 300 such that movement of the bristle beds 304 occurs in both a radial and a circumferential direction. This may provide greater flexibility of motion compared to either radial or circumferential motion alone.

As mentioned previously, movement of a bristle bed 304 causes the bristle bed 304 to leave the slot 306 and move circumferentially around the periphery of the attachment to the slot 306 on the opposing side of the attachment 300. In particular, and as seen in FIG. 12, when engaged with hair and tension is applied by the hair in a first direction, the first bristle bed 304*a* rotates clockwise about a periphery of the attachment 300 and moves about the main body 302 such that the first bristle bed 304*a* contacts a second bristle bed 304*b* and displaces the second bristle bed 304*b* within its slot 306. In doing so, a portion of the first bristle bed 304*a* covers part of one slot 306 whilst another portion of the first bristle bed 304*a* is located within the other slot 306.

In such a manner, a cross-sectional area of the first air outlet 308*a* defined by the first bristle bed 304*a* is increased, whilst airflow through the second air outlet 308*b* defined by the first bristle bed 304*a*, and airflow through the air outlets 308 defined by the second bristle bed 304*b*, is blocked.

Thus an air outlet 308 on a first side 320 of the attachment 300 engaged with hair in use may experience an increase in cross-sectional area, whilst air outlets 308 on a second side 322 of the attachment 300 not engaged with hair in use may experience a decrease in cross-sectional area, with air outlets 308 on the second side 322 of the haircare appliance being closed in response to an increase in cross-sectional area of air outlets 308 on a first opposing side 320 of the attachment 300. This may enable a greater volume of airflow to be provided through one side of the attachment 300 relative to the other opposing side of the attachment 300, which may provide increased efficiency, for example with less wasted airflow directed away from hair in use, and may provide increased styling control with airflow primarily directed only in a desired direction in use, thereby decreasing the risk of stray airflow affecting a styling process. The first 320 and second 322 sides of the attachment 300 are located on opposite sides of a central longitudinal axis C of the attachment 300.

The attachment 300 of FIGS. 10 to 12 is therefore similar to the attachment 100 of FIGS. 3 to 6, and the attachment of FIGS. 7 to 9, in that motion of one bristle bed 304 causes motion of at least one another bristle bed 304 in use.

A further embodiment of an attachment 400 is illustrated schematically in FIGS. 13 to 16.

The attachment 400 of FIGS. 13 to 16 is similar to the attachment 100 of FIGS. 3 to 6, the attachment 200 of FIGS. 7 to 9, and the attachment 300 of FIGS. 10 to 12, in that the attachment 100 of FIGS. 13 to 16 comprises a main body 402 and bristle beds 404 located in slots 406 formed in the main body 402. Here the bristle beds 404 have a width less than an outermost width of the slots 406, and are located radially inwardly of the main body 402 such that the bristle beds 404 cannot move radially outwardly from the main body 402 through the slots 406. Each bristle bed 404, along with an adjacent portion of the main body 302, at least partially defines two air outlets 408.

Each bristle bed 404 comprises a body portion 410 with a plurality of bristles 412 extending outwardly from the body portion 410. The bristle beds 404 are connected together by a continuous resilient band 414. Although shown here as a single continuous resilient band 414, it will be appreciated that a number of continuous resilient bands may be provided, for example spaced longitudinally along a length of the bristle beds 404, to provide even motion along the length of the bristle beds 404.

Figure 14:
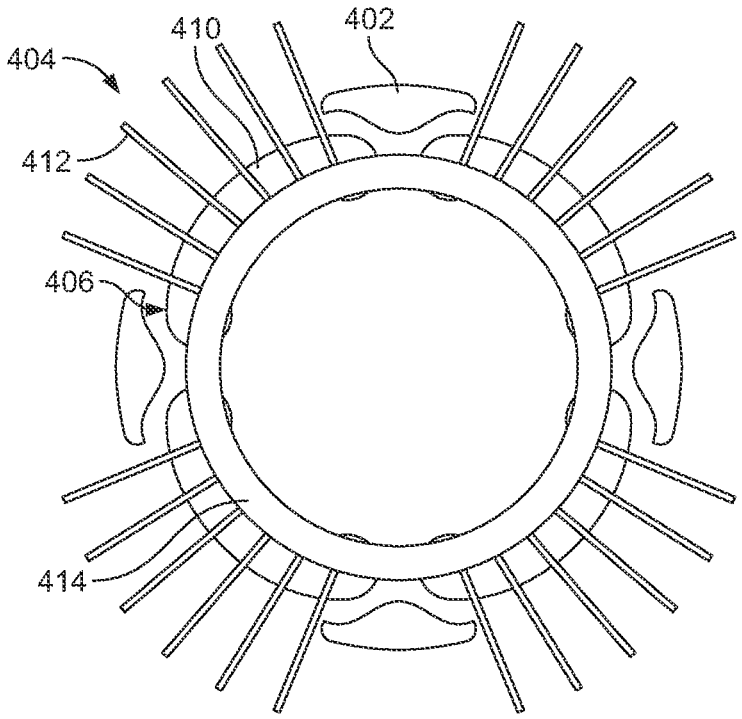
FIG. 14 is a schematic illustration of the attachment of FIG. 13 in the absence of any applied forces.

As seen from FIG. 14, the continuous resilient band 414 is generally circular in the absence of any applied force, with the continuous resilient band 414 having a diameter smaller than a diameter of the main body 402 in the absence of any applied force.

Figure 15:
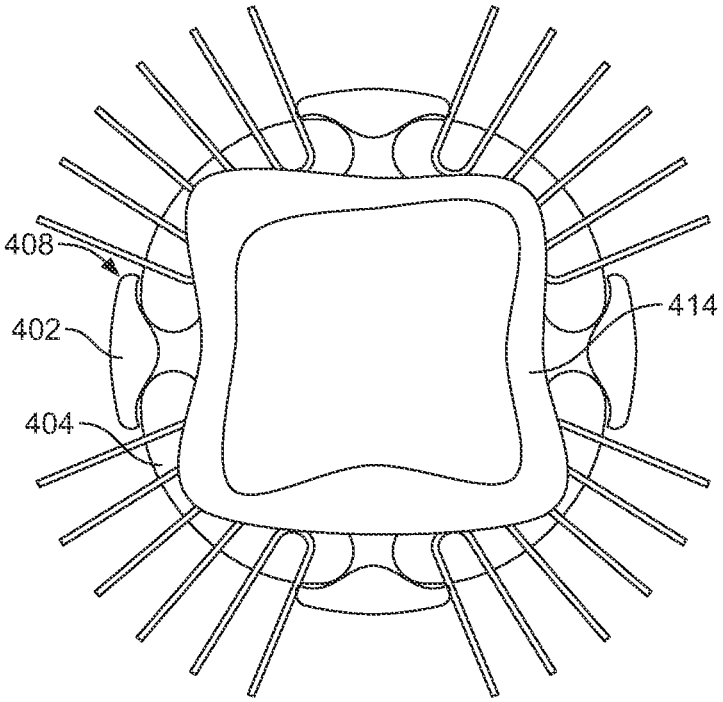
FIG. 15 is a schematic illustration of the attachment of FIG. 13 in a rest configuration.

When airflow flows through the attachment 400 in use, and the attachment is not engaged with hair, the internal air pressure of the attachment 400 forces the bristle beds 404 radially outwardly, but the resilience of the continuous resilient band 414 is such that the bristle beds 404 do not close the air outlets 408. This is referred to as a rest configuration, and is illustrated in FIG. 15. In the rest configuration airflow through each air outlet 408 is substantially equal, and diffuse airflow may be provided about the periphery of the attachment 400 through each air outlet 408.

Figure 16:
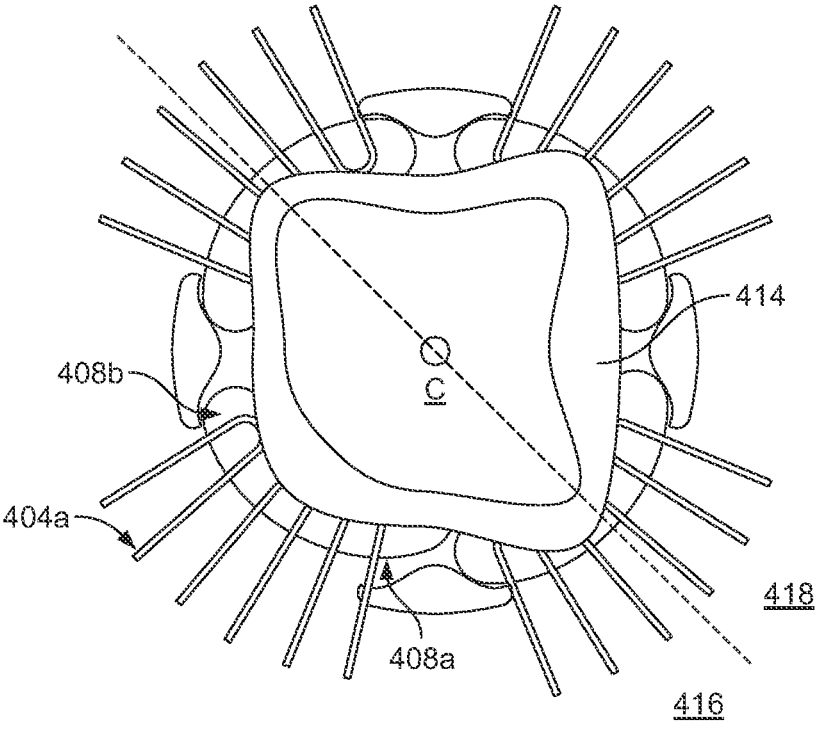
FIG. 16 is a schematic illustration of the attachment of FIG. 13 engaged with hair in use.

When bristles 412 of a bristle bed 404 engage with hair in use, as illustrated in FIG. 16, the force applied to the bristle bed 404 via the engagement with, and relative movement to, hair pulls that bristle bed 404 to move the bristle bed 404 within the slot 406, thereby varying a cross-sectional area of the air outlets 408 defined by that bristle bed 404. For example, in FIG. 16 a cross-sectional area of a first air outlet 408*a* defined by a first bristle bed 404*a* is increased in response to engagement with hair and relative movement in a first direction, whilst a cross-sectional area of a second air outlet 408*b* defined by the first bristle bed 404*a* is decreased in response to engagement with hair and relative movement in the first direction. In such a manner an increased amount of airflow may pass through the first air outlet 408*a* in response to engagement of the first bristle bed 404*a* with hair in use. It will of course be appreciated that engagement with hair and relative motion in a second direction opposite to the first direction will decrease the cross-sectional area of the first air outlet 408*a* whilst increasing the cross-sectional area of the second air outlet 404*b*.

The bristle beds 404 are movable within the slots 406 in response to engagement of hair with the attachment 400 such that movement of the bristle beds occurs in both a radial and a circumferential direction. This may provide greater flexibility of motion compared to either radial or circumferential motion alone.

As previously mentioned, each of the bristle beds 404 is linked to adjacent bristle beds 404 by the continuous resilient band 414. When a bristle bed 404, for example the first bristle bed 404*a* of FIG. 16, is engaged with hair in use, forces from such an engagement apply forces to the bristle bed 404 that cause the bristle bed 404 to move slightly radially inwardly toward the centre of the attachment 400. Such a radial motion causes the continuous resilient band 414 to relax slightly in the region of the bristle bed 404 that is engaged with hair. This enables motion of the remaining bristle beds 404, aided by airflow within the interior of the attachment 400, to move to close their corresponding air outlets 408.

Thus air outlets 408 on a first side 416 of the attachment 400 engaged with hair in use may experience an increase in cross-sectional area, whilst air outlets 408 on a second side 418 of the attachment 400 not engaged with hair in use may experience a decrease in cross-sectional area, with air outlets 408 on the second side 418 of the attachment 400 being closed in response to an increase in cross-sectional area of air outlets 408 on a first opposing side 416 of the attachment 400. This may enable a greater volume of airflow to be provided through one side of the attachment 400 relative to the other opposing side of the attachment 400, which may provide increased efficiency, for example with less wasted airflow directed away from hair in use, and may provide increased styling control with airflow primarily directed only in a desired direction in use, thereby decreasing the risk of stray airflow affecting a styling process. The first 416 and second 418 sides of the attachment 400 are located on opposite sides of a central longitudinal axis C of the attachment 400.

As seen in FIG. 16, the slots 406 in the main body 402, and the bristle beds 404, are shaped such that airflow through the air outlets 408 in use is in a direction having a tangential as well as a radial component. This may assist in directing airflow along a length of hair in use, which may provide increased efficiency and decreased dry times.

Each of the attachments 100,200,300,400 described above are similar in that motion of one bristle bed causes motion of at least one another bristle bed in use.

Embodiments are also envisaged where, rather than the haircare appliance 10 comprising a handle unit 12 and an attachment 100,200,300,400 the haircare appliance is a single-piece unit, for example taking the form of the combined handle unit 12 and attachment 100,200,300,400 previously described.

Whilst embodiments described herein have been depicted with "first" and "second" sides, it will be appreciated by a person skilled in the art that in practice whichever side of the attachment 100,200,300,400 is engaged with hair may be considered a "first side" as discussed herein, with the opposite side of the attachment 100,200,300,400 not engaged with hair considered a "second side" as discussed herein.

Similarly, it will be apparent to a person skilled in the art that the number of bristle beds of the attachments 100,200, 300,400 described herein may vary from those shown, for example with attachments having at least two bristle beds envisaged.

The invention claimed is:

1. An attachment for a haircare appliance comprising an air inlet for receiving an airflow, and an air outlet for emitting airflow, wherein the air outlet comprises a first aperture at least partially defined by a first movable member, and a second aperture at least partially defined by a second movable member, each of the first and second movable members movable to vary a cross-sectional area of the respective first and second apertures, wherein movement of the first movable member to increase the cross-sectional area of the first aperture causes a decrease in internal air pressure of the attachment in use, and wherein the decrease in internal air pressure causes movement of the second movable member to decrease the cross-sectional area of the second aperture.

2. The attachment as claimed in claim 1, wherein the attachment comprises a central axis, the first and second movable members are located on opposing sides of the central axis, and the first and second apertures are located on opposing sides of the central axis.

3. The attachment as claimed in claim 1, wherein movement of the first movable member in a direction causes movement of the second movable member in the same direction.

4. The attachment as claimed in claim 1, wherein movement of the first movable member in a first direction increases the cross-sectional area of the first aperture, movement of the second movable member in the first direction decreases the cross-sectional area of the second aperture, movement of the first movable member in a second direction opposite to the first direction decreases the cross-sectional area of the first aperture, and movement of the second movable member in the second direction increases the cross-sectional area of the second aperture.

5. The attachment as claimed in claim 1, wherein movement of the first and second movable members is constrained such that the first and second apertures comprise respective maximal and minimal cross-sectional areas at boundaries of motion of the first and second movable members.

6. The attachment as claimed in claim 5, wherein the first aperture comprises its maximal cross-sectional area when the second aperture comprises its minimal cross-sectional area, and the first aperture comprises its minimal cross-sectional area when the second aperture comprises its maximal cross-sectional area.

7. The attachment as claimed in claim 5, wherein the first and second movable members are biased to a rest configuration in use, and the first and second apertures comprise cross-sectional areas intermediate their maximal and minimal cross-sectional areas when the first and second movable members are in their respective rest configurations.

8. The attachment as claimed in claim 7, wherein the first and second movable members are biased to the rest configuration by airflow flowing through the attachment in use.

9. The attachment as claimed in claim 8, wherein the first and second movable members are biased to the rest configuration against the force of a biasing member.

10. The attachment as claimed in claim 1, wherein the first and second movable members are movable in response to the attachment engaging hair in use.

11. The attachment as claimed in claim 1, wherein the first and second movable members each comprise a plurality of bristles, and the first and second movable members are movable in response to the bristles engaging hair in use.

12. The attachment as claimed in claim 1, wherein movement of the first movable member causes the first movable member to contact and cause movement of the second movable member.

13. The attachment as claimed in claim 1, wherein the first and second movable members are linked by at least one mechanical link.

14. The attachment as claimed in claim 13, where the at least one mechanical link is resiliently deformable such that movement of the first movable member causes movement of the second movable member.

15. The attachment as claimed in claim 1, wherein the attachment comprises a third movable member, the first, second and third movable members spaced about a periphery of the attachment, and adjacent movable members are linked by a mechanical link.

16. The attachment as claimed in claim 15, wherein each movable member is linked to the other movable members by a continuous mechanical link.

17. The attachment as claimed in claim 1, wherein the attachment comprises a fixed member, the first and second movable members are movable relative to the fixed member, and the fixed member at least partially defines the first and second apertures.

18. The attachment as claimed in claim 17, wherein the fixed member is shaped such that airflow through the first and second apertures comprises a component tangential to the attachment.

19. The attachment as claimed in claim 1, wherein the second aperture is circumferentially spaced apart from the first aperture about a central axis of the attachment.

20. A haircare appliance comprising an air inlet, an air outlet, and an airflow generator for generating an airflow from the air inlet to the air outlet, wherein the air outlet comprises a first aperture at least partially defined by a first movable member, and a second aperture at least partially defined by a second movable member, each of the first and second movable members are movable to vary a cross-sectional area of the respective first and second apertures, and movement of the first movable member causes movement of the second movable member due to a difference in air pressure of the haircare appliance in use when the cross-sectional area of the first aperture is varied by the first movable member.

21. The haircare appliance as claimed in claim 20, wherein the haircare appliance comprises a handle unit within which the airflow generator is disposed, and an attachment comprising the air outlet and the first and second movable members, the attachment removably attachable to the handle unit.

22. The haircare appliance as claimed in claim 20, wherein the second aperture is circumferentially spaced apart from the first aperture about a central axis of the haircare appliance.

* * * * *